US007641521B2

(12) United States Patent
Pepe et al.

(10) Patent No.: US 7,641,521 B2
(45) Date of Patent: Jan. 5, 2010

(54) ELECTRICAL CONNECTOR WITH COMPENSATION LOOPS

(75) Inventors: Paul John Pepe, Clemmons, NC (US); Shawn Phillip Tobey, Trinity, NC (US); Sheldon Easton Muir, Whitsett, NC (US); Steven Richard Bopp, Jamestown, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 78 days.

(21) Appl. No.: 12/103,582

(22) Filed: Apr. 15, 2008

(65) Prior Publication Data

US 2009/0258545 A1 Oct. 15, 2009

(51) Int. Cl.
*H01R 24/00* (2006.01)

(52) U.S. Cl. ..... 439/676; 439/620.22; 439/941

(58) Field of Classification Search ..... 439/676, 439/620.22, 941

See application file for complete search history.

(56) References Cited

U.S. PATENT DOCUMENTS 6,533,618 B1 3/2003 Aekins
7,575,483 B1 * 8/2009 Zhang ..... 439/676
2005/0099243 A1 5/2005 Weng
2005/0202697 A1 9/2005 Caveney et al.
2006/0121789 A1 6/2006 Hashim
2006/0286873 A1 12/2006 Caveney et al.

FOREIGN PATENT DOCUMENTS

FR 2 906 939 4/2008
GB 2 380 334 4/2003

OTHER PUBLICATIONS

PCT International Search Report; International Application No. PCT/US2009/002315; International Filing Date Apr. 13, 2009.

* cited by examiner

*Primary Examiner*—Tho D Ta

(57) ABSTRACT

A electrical connector includes a housing and a plurality of contacts within the housing configured for mating engagement with mating contacts of a mating connector. The electrical connector also includes a compensation component housed within the housing. The compensation component has a substrate with a first trace plane and a second trace plane, and the compensation component has a plurality of traces arranged on the first trace plane. The traces are electrically connected to selected ones of the contacts. At least one of the traces includes a compensation loop arranged on the first trace plane, and at least one of the traces includes a compensation loop arranged on the second trace plane. The compensation loop provides at least one of electrical and thermal compensation.

20 Claims, 4 Drawing Sheets

ELECTRICAL CONNECTOR WITH COMPENSATION LOOPS

BACKGROUND OF THE INVENTION

The subject matter herein relates generally to electrical connectors, and more particularly, to electrical connectors that use compensation loops to enhance electrical performance and/or to improve thermal management.

Electrical connectors are commonly used in telecommunication systems. The electrical connectors, such as modular jacks and modular plugs, provide an interface between successive runs of cables and/or between cables and electronic devices in such systems. These connectors have contacts which are arranged according to a known industry standard such as Electronics Industries Alliance/Telecommunications Industry Association ("EIA/TIA")-568. These connectors have traditionally been used for data transmission, wherein the contacts of the connectors transmit data signals therebetween. There is a growing trend toward using these types of connectors in Power-Over-Ethernet applications, wherein power is transmitted between the electrical connectors.

Due to increases in data transmission rates in telecommunications systems, the electrical performance of the electrical connector is effected by crosstalk. Prior art techniques have focused on modular jacks and on arranging the contacts within the housing of the electrical connector to provide compensation for the crosstalk. However, controlled positioning of the contacts is difficult to achieve in manufacture or assembly, and the electrical connectors tend to have a high amount of variation between different electrical connectors. Additionally, electrical connectors that are used in Power-Over-Ethernet applications carry current through the contacts, which may damage the contacts during use, such as by overheating the contacts. A need remains for an electrical connector that compensates for signal degradation and/or thermal degradation.

BRIEF DESCRIPTION OF THE INVENTION

In one embodiment, an electrical connector is provided that includes a housing and a plurality of contacts within the housing. The electrical connector also includes a compensation component housed within the housing. The compensation component has a substrate with a first trace plane and a second trace plane, and the compensation component has a plurality of traces arranged on the first trace plane. The traces are electrically connected to selected ones of the contacts. At least one of the traces includes a compensation loop arranged on the first trace plane, and at least one of the traces includes a compensation loop arranged on the second trace plane. The compensation loop provides at least one of electrical and thermal compensation.

Optionally, each compensation loop may include at least two tap points along the respective trace. At least one of the traces may include a compensation loop extending from the trace in a first direction and another compensation loop extending from the trace in a second direction different than the first direction. Each trace may include a primary trace, wherein each primary trace is arranged within the first trace plane and extends parallel to one another, and wherein each trace includes at least one compensation loop that extends substantially perpendicular from the primary trace. Optionally, each trace may include a primary trace and the compensation loops, wherein the compensation loops are positioned relatively closer to an adjacent trace to increase an amount of inductive coupling therebetween. The contacts may be configured for power transmission, wherein each compensation loop splits the current path into parallel paths to reduce the heat generated for a given region of the current path. The length and proximity of the compensation loops may be selected to control the electrical performance of the electrical connector. Optionally, the substrate may define multiple layers with each layer defining a potential trace plane, wherein compensation loops are provided on at least three of the potential trace planes.

In another embodiment, an electrical connector is provided that includes a housing and a plurality of contacts within the housing. The electrical connector also includes a compensation component housed within the housing. The compensation component has a substrate and a plurality of traces electrically connected to selected ones of the contacts, wherein each of the traces include at least one compensation loop having at least two tap points along the respective trace. The compensation loops are arranged to control the electrical performance of the electrical connector. Optionally, at least one of the traces may include a compensation loop extending from the trace in a first direction and another compensation loop extending from the trace in a second direction different than the first direction.

In a further embodiment, an electrical connector is provided that includes a housing and a plurality of contacts within the housing. The electrical connector also includes a compensation component housed within the housing. The compensation component has a substrate with a top and a bottom. The compensation component also has four traces arranged on the top of the substrate, with first and second traces defining a first differential pair and third and fourth traces defining a second differential pair. Each trace has at least one compensation loop extending therefrom, wherein the compensation loops are arranged to control the electrical performance of the electrical connector.

Optionally, the compensation loops associated with the first and third traces may be arranged along the bottom of the substrate. The substrate may include an intermediate layer between the top and the bottom, wherein at least two of the traces include compensation loops arranged along the intermediate layer to provide either inductive or capacitive coupling therebetween. Optionally, the third trace may have a compensation loop arranged along the intermediate layer to control coupling between the first and third traces, and the fourth trace may have a compensation loop arranged along the intermediate layer to control coupling between the second and fourth traces. At least one of the second and third traces may include a compensation loop arranged along the top of the substrate that extends between the second and third traces to control coupling between the second and third traces.

DETAILED DESCRIPTION OF THE INVENTION

Figure 1:
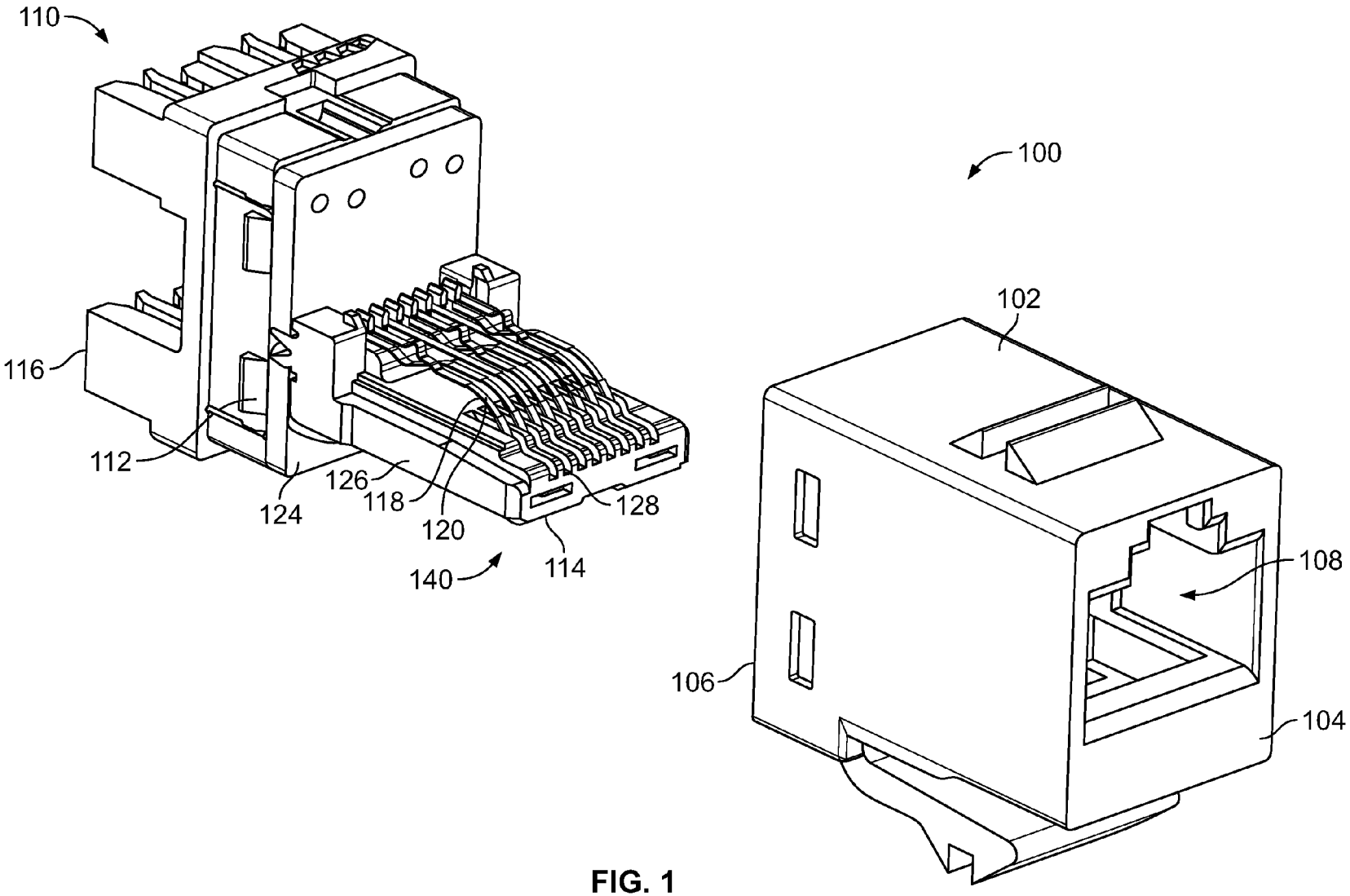
FIG. 1 is an exploded view of an electrical connector formed in accordance with an exemplary embodiment.

FIG. 1 is an exploded view of an electrical connector 100 formed in accordance with an exemplary embodiment. In the illustrated embodiment, the connector 100 is a modular 8-pin connector, such as an RJ-45 jack. The connector 100 is configured for joining with a mating plug (not shown). While the connector 100 is shown and described with reference to an RJ-45 jack, the subject matter herein may be used with other types of connectors, and the RJ-45 jack is merely illustrative of an exemplary embodiment. The connector 100 may be used for data transmission, such as in a telecommunications application. The connector 100 may be used for power transmission, such as in a Power-Over-Ethernet application.

The connector 100 includes a housing 102 extending between a mating end 104 and a loading end 106. A cavity 108 extends between the mating end 104 and the loading end 106. The cavity 108 receives the mating plug through the mating end 104.

The connector 100 includes a contact sub-assembly 110 received within the housing 102 through the loading end 106 of the housing 102. The contact sub-assembly 110 is secured to the housing 102 via tabs 112. The contact sub-assembly 110 extends between a mating end 114 and a wire terminating end 116 and is held within the housing 102 such that the mating end 114 of the contact sub-assembly 110 is positioned proximate the mating end 104 of the housing 102. The wire terminating end 116 extends outward or rearward from the loading end 106 of the housing 102. The contact sub-assembly 110 includes an array of mating pins or mating contacts 118. Each of the mating contacts 118 include a mating interface 120 arranged within the cavity 108 to interface with corresponding pins or contacts (not shown) of the mating plug when the mating plug is joined with the connector 100. The arrangement of the mating contacts 118 may be controlled by industry standards, such as EIA/TIA-568. In an exemplary embodiment, the connector 100 includes eight mating contacts 118 arranged as differential pairs.

The contact sub-assembly 110 includes a plurality of wire terminating contacts 122 (shown in FIG. 2) at the wire terminating end 116. The contacts 122 are connected to a circuit board 124, and interconnected to corresponding ones of the contacts 118 by the circuit board 124.

A base 126 extends between the mating end 114 of the contact sub-assembly 110 and the circuit board 124. The mating contacts 118 are supported by the base 126. In an exemplary embodiment, a plurality of parallel channels 128 extend rearward from the mating end 114. Portions of the contacts 118 are received in corresponding channels 128. Optionally, the contacts 118 are movable within the channels 128 to allow flexing of the contacts 118 as the connector 100 is mated with the mating plug. Each of the contacts 118 extends generally parallel to one another and the mating interfaces 120 of each contact 118 are generally aligned with one another.

In an exemplary embodiment, the electrical connector 100 includes at least one compensation component that is configured to electrically connect to selected ones of the mating contacts 118. In the illustrated embodiment, the circuit board 124 defines a first compensation component, and may be referred to hereinafter as the first compensation component 124. Additionally, the base 126 of the contact sub-assembly 110 may include or define a second compensation component 140. While two compensation components 124, 140 are shown and described in the illustrated embodiment, any number of compensation components may be provided in alternative embodiments. Some embodiments may include only a single compensation component.

As described in further detail below, the compensation components 124, 140 are configured to control the electrical performance of the electrical connector 100. The compensation components 124, 140 may be configured to provide thermal management and control heat dissipation, such as in a Power-Over-Ethernet application. The compensation components 124, 140 include elements, such as traces on at least one surface of a circuit board, that provide electrical and/or thermal compensation, either for controlling electrical interactions, such as by inductive or capacitive coupling, or for controlling heat dissipation.

Figure 2:
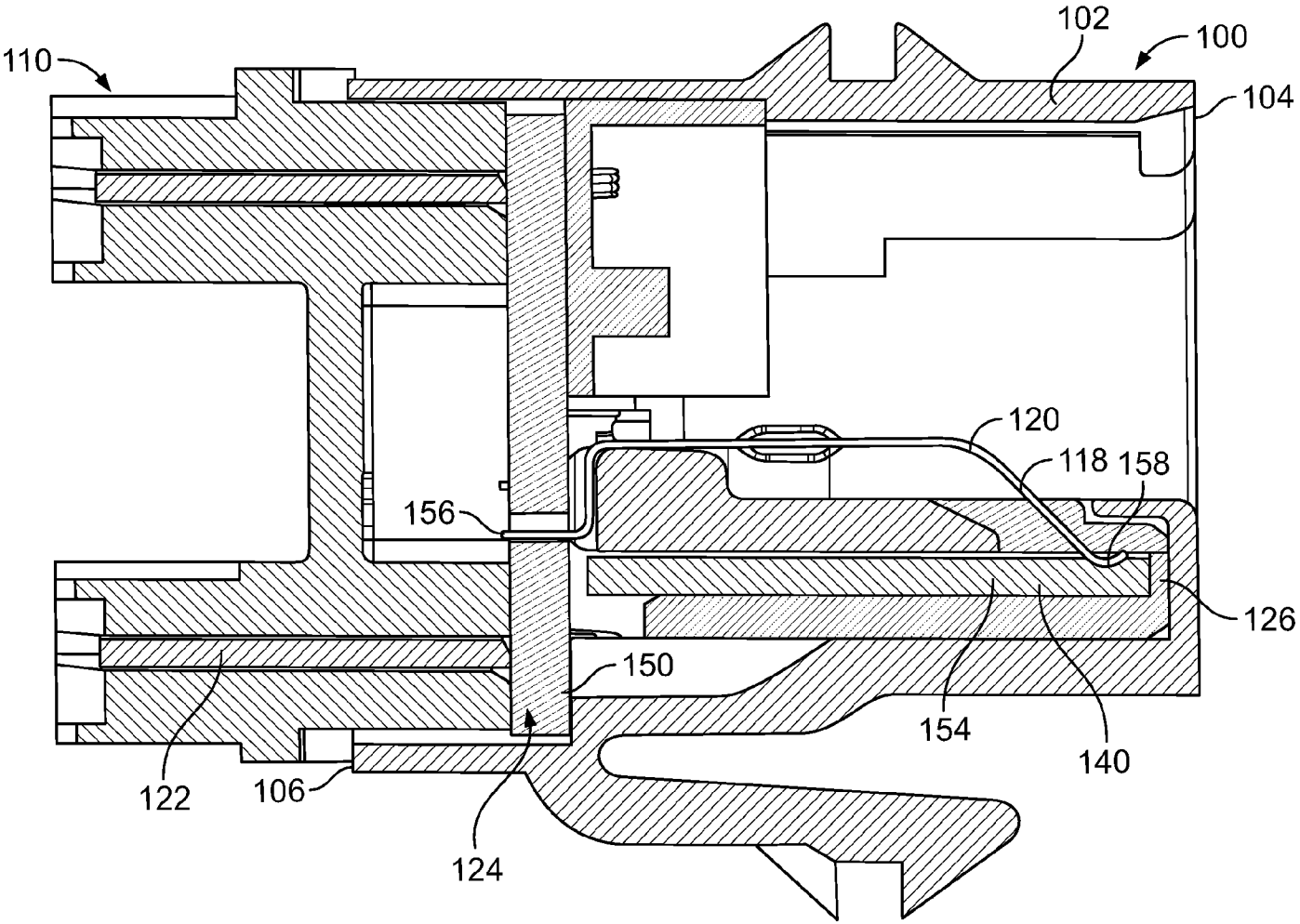
FIG. 2 is a cross-sectional view of the electrical connector shown in FIG. 1.

FIG. 2 is a cross sectional view of the electrical connector 100 with the contact sub-assembly 110 received within the housing 102. The compensation components 124, 140 are illustrated within the housing 102. As described above, the first compensation component 124 includes a substrate 150, in the form of a circuit board, having traces (not shown in FIG. 2) arranged thereon. As described in further detail below, the traces provide compensation. Similarly, the second compensation component 140 includes a substrate 154, in the form of a circuit board, having traces (not shown in FIG. 2) thereon. Optionally, the traces may be arranged in predetermined orientations to provide compensation or electrical interactions therebetween. Alternatively, additional or secondary traces or other elements may be included to provide the compensation. Compensation components having structures other than circuit boards having traces may be used in alternative embodiments. For example, an overmolded leadframe may define a compensation component.

The first compensation component 124 is positioned within the housing 102 such that first ends 156 of the mating contacts 118 engage the substrate 150. More specifically, the mating contacts 118 are coupled to the circuit board 124 by through-hole mounting, however other interconnection means may be provided. As such, the first compensation component 124 is directly connected to the mating contacts 118. In an exemplary embodiment, the substrate 150 is rectangular in shape, and is oriented vertically within the housing 102, which is generally parallel to the mating end 104 and the loading end 106.

The second compensation component 140 forms part of the base 126 and is positioned within the housing 102 such that the mating contacts 118 directly engage the second compensation component 140. For example, the mating contacts 118 may rest upon, and electrically connect to, the traces, or contact pads associated with the traces. In an exemplary embodiment, the substrate 154 is rectangular in shape, and is oriented horizontally within the housing 102. The substrate 154 extends at least partially between the mating end 104 and the loading end 106. The substrate 154 is mounted within the base 126 and at least a portion of the substrate 154 is exposed from above so that the mating contacts 118 may engage the substrate 150. At least a portion of the substrate 154 is positioned vertically below the cavity 108 that receives the mating connector. In an alternative embodiment, the mating contacts 118 may indirectly engage the traces of the substrate 154. For example, an interconnecting element or contact, such as a metal plate may extend between the substrate 154 and the mating contact 118.

The positions of the compensation components 124, 140 illustrated in FIG. 2 are exemplary, and the compensation components 124, 140 may be positioned anywhere within the housing 102 in alternative embodiments. Additionally, the compensation components 124, 140 may engage and provide compensation for any number of the mating contacts 118.

Figure 3:
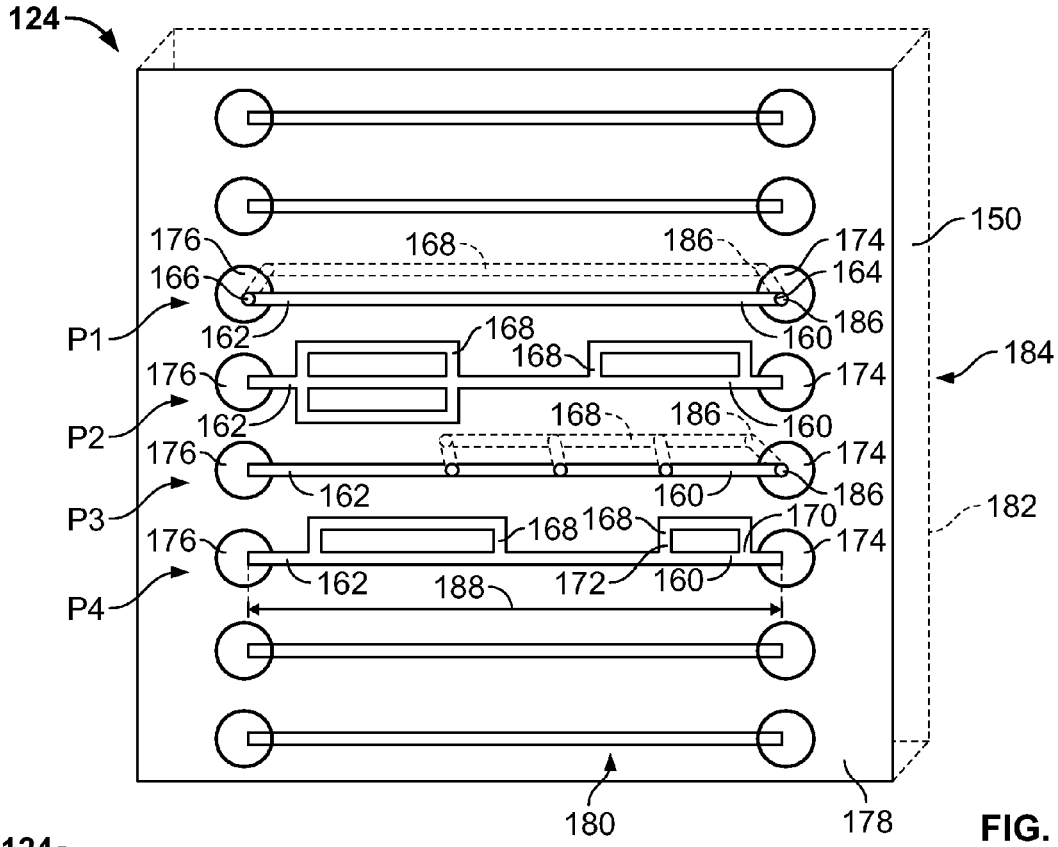
FIG. 3 is a schematic illustration of a compensation component for use with the electrical connector shown in FIGS. 1 and 2.

FIG. 3 is a schematic illustration of the first compensation component 124, however it is realized that the principles of operation and functions of the second compensation component 140 may be similar to those described below. The compensation component 124 includes the substrate 150 and a plurality of traces 160. Each trace 160 includes a primary trace 162 that extends between a first end 164 and a second end 166. Additionally, at least some of the traces 160 include at least one compensation loop 168 that defines a secondary trace connected to the primary trace 162 at least two tap points 170, 172. Some of the traces 160 may not include any compensation loops 168. The primary trace 162 and the compensation loops 168 cooperate to define paths or circuits. In the illustrated embodiment, four traces 160 are provided that correspond to, and provide compensation for, four of the mating contacts 118, such as the middle four mating contacts 118. The paths or circuits defined by the traces 160 are identified in FIG. 3 as path P1, path P2, path P3 and path P4. Optionally, paths P1 and P2 may correspond to one differential pair and paths P3 and P4 correspond to another differential pair. However, any number of traces 160 and paths may be provided in alternative embodiments, and the number of traces 160 and paths may or may not correspond to the number of mating contacts 118.

A first interface 174 is provided at the first end 164 of each of the primary traces 162. A second interface 176 is provided at the second end 166 of each of the primary traces 162. The interfaces 174 and/or 176 provide a location for interfacing with the mating contacts 118 (shown in FIG. 3) and/or terminating contacts 122. The interfaces 174, 176 define through-holes for receiving the mating contacts 118 and the terminating contacts 122, respectively.

In an exemplary embodiment, the primary traces 162 are each provided on a top surface 178 of the substrate 150. The top surface 178 defines a first trace plane 180. At least some of the compensation loops 168 are also provided on the first trace plane 180. Optionally, at least some of the compensation loops 168 may be provided on a bottom surface 182 of the substrate 150, which defines a second trace plane 184. The traces 160 may extend along vias 186 that extend between the top surface 178 and the bottom surface 182. The vias 186 form part of the path and electrically interconnect the compensation loops 168 with the primary traces 162. In alternative embodiments, additional trace planes may be provided on which the compensation loops 168 may be provided. For example, a multi-layer circuit board may be provided wherein traces may be provided on any of the layers of the circuit board. Additionally, in some embodiments, the primary traces 162 may be provided on any of the trace planes, as opposed to each of them being on the first trace plane 180, as in the illustrated embodiment.

The compensation loops 168 are located in predetermined locations and with predetermined lengths and/or widths to provide electrical and/or thermal compensation. The thermal compensation is provided by increasing the overall trace or path surface area. In power applications, by providing a compensation loop 168, the current transmitted along the path (e.g. path P1) is split between the primary trace 162 and the compensation loop 168, thus increasing the overall surface area of the trace 160. Thus, the trace 160 is able to dissipate more heat as compared to the amount of heat that may be dissipated by the primary trace 162 alone. The electrical compensation is provided by inductive or capacitive coupling between the traces 160. A predetermined amount of coupling is provided between the various primary traces 162. Adjacent primary traces 162 have stronger coupling than remote, non-adjacent primary traces 162. The compensation loops 168 enhance the coupling between various ones of the traces 160 and the placement and orientation of the compensation loops 168 may be used to control the amount of compensation. For example, the amount of compensation may depend on the signal path area, the length or surface area of the primary trace 162 and the compensation loops 168, the trace material and/or the dielectric material of the substrate 150, the thickness of the substrate 150, the proximity of the compensation loops 168 to the adjacent primary trace 162 and/or other compensation loops 168, and the like.

In the illustrated embodiment, each of the interfaces 174 and 176 are separated by a distance 188. The primary traces 162 extend linearly between the interfaces 174, 176 and thus have a length that is equal to the distance 188. The primary traces 162 are each parallel to one another. The first path P1 includes a compensation loop 168 on the second trace plane 184. The compensation loop 168 extends generally perpendicularly from the primary trace 162 through vias 186 proximate the first interface 174 and the second interface 176. The portion of the compensation loop 168 on the second trace plane 184 is generally parallel to the primary trace 162. The length of the trace 160 is approximately twice the length of the primary trace 162 with the addition of the compensation loop 168.

The second path P2 includes a plurality of compensation loops 168. One of the compensation loops 168 is located proximate the first interface 174. Another of the compensation loops 168 is located proximate the second interface 176. Both compensation loops 168 extend generally perpendicularly from the primary trace 162 and include a portion that extends generally parallel to the primary trace 162. In the illustrated embodiment, both compensation loops 168 are more closely positioned with respect to the primary trace 162 of the first path P1 to increase the coupling between the second path P2 and the first path P1. One of the compensation loops 168 is also more closely positioned with respect to the primary trace of the third path P3 to increase the coupling between the second path P2 and the third path P3. The lengths of traces forming the compensation loops 168 are selected to control an amount of coupling between the first path P1 and the second path P2. As such, the electrical characteristics and interactions therebetween can be tuned. For example, a given amount of cross-talk can be achieved and/or the impedance of the circuit can be controlled to a certain amount, such as 100 Ohms. Other electrical characteristics may also be controlled by selecting the length, surface area and/or position of the compensation loops 168.

The third path P3 includes a compensation loop 168 on the second trace plane 184. The compensation loop 168 extends through a plurality of vias 186 defining a plurality of tap points. The number of vias 186 may increase the overall path length of the third path P3. One of the vias 186 is located proximate the first interface 174. Positioning the compensation loop 168 on the same trace plane as the compensation loop 168 of the first path P1, namely the second trace plane 184, coupling may be achieved between the first path P1 and the third path P3. The length of the compensation loop 168 of the third path P3 may be selected to achieve a predetermined amount of coupling between the first path P1 and the third path P3.

The fourth path P4 includes a plurality of compensation loops 168. One of the compensation loops 168 is located proximate the first interface 174. Another of the compensation loops 168 is located proximate the second interface 176. Both compensation loops 168 extend generally perpendicularly from the primary trace 162 and include a portion that extends generally parallel to the primary trace 162. In the illustrated embodiment, both compensation loops 168 are more closely positioned with respect to the primary trace 162 of the third path P3. The lengths of traces forming the compensation loops are selected to control an amount of coupling between the fourth path P4 and the third path P3. As such, the electrical characteristics and interactions therebetween can be tuned. For example, a given amount of cross-talk can be achieved and/or the impedance of the circuits can be controlled to a certain amount, such as 100 Ohms. Other electrical characteristics may also be controlled by selecting the length, surface area and/or position of the compensation loops 168.

Figure 4:
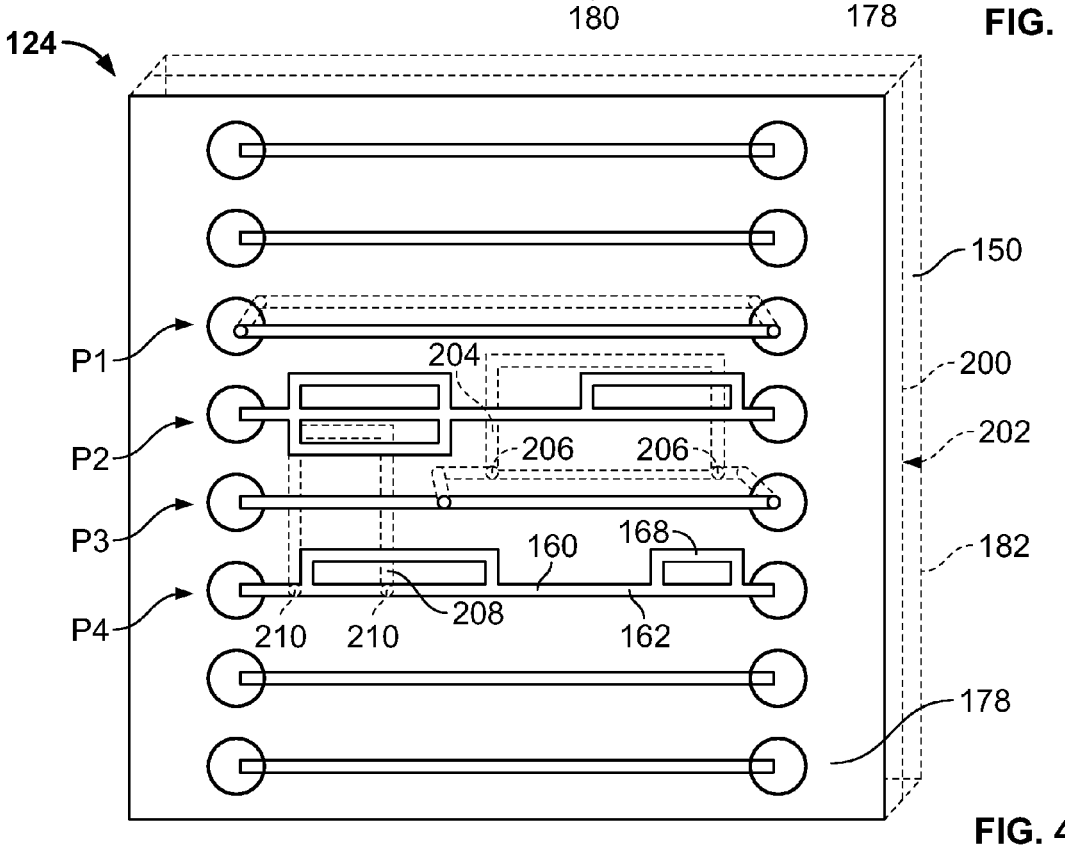
FIG. 4 is a schematic illustration of an alternative compensation component.

FIG. 4 is a schematic illustration of the first compensation component 124 formed in accordance with an alternative embodiment. The compensation component 124 is similar to the compensation component illustrated in FIG. 3, and like components are illustrated and described using like reference numerals. The compensation component 124 includes the substrate 150 and the plurality of traces 160. Each of the traces 160 includes the primary trace 162 and at least one compensation loop 168. The primary trace 162 and the compensation loops 168 cooperate to define paths or circuits. In the illustrated embodiment, first, second, third and fourth traces are provided and are identified in FIG. 4 as path P1, path P2, path P3 and path P4.

The compensation component 124 also includes an intermediate layer 200 between the top surface 178 and the bottom surface 182 that defines a third trace plane 202. Each of the compensation loops 168 described in FIG. 3 are present in the embodiment of FIG. 4, however, the embodiment of FIG. 4 includes additional compensation loops 168 on the intermediate layer 200. In the illustrated embodiment, the third trace 160, forming path P3, includes a compensation loop 204 on the intermediate layer 200 that is positioned to provide coupling with the first trace 160, forming path P1. Vias 206 extend from the bottom surface 182 to the intermediate layer 200. At least a portion of the compensation loop 204 is provided in the vicinity of the first trace 160 to allow capacitive or inductive coupling therebetween. Similarly, the fourth trace 160, forming path P4, includes a compensation loop 208 on the intermediate layer 200 that is positioned to provide coupling with the second trace 160, forming path P2. Vias 210 extend from the top surface 178 to the intermediate layer 200. At least a portion of the compensation loop 168 is provided in the vicinity of the second trace P2 to allow capacitive or inductive coupling therebetween. Other layers may be provided in alternative embodiments with compensation loops 168 thereon to interact with other ones of the traces 160.

Figure 5:
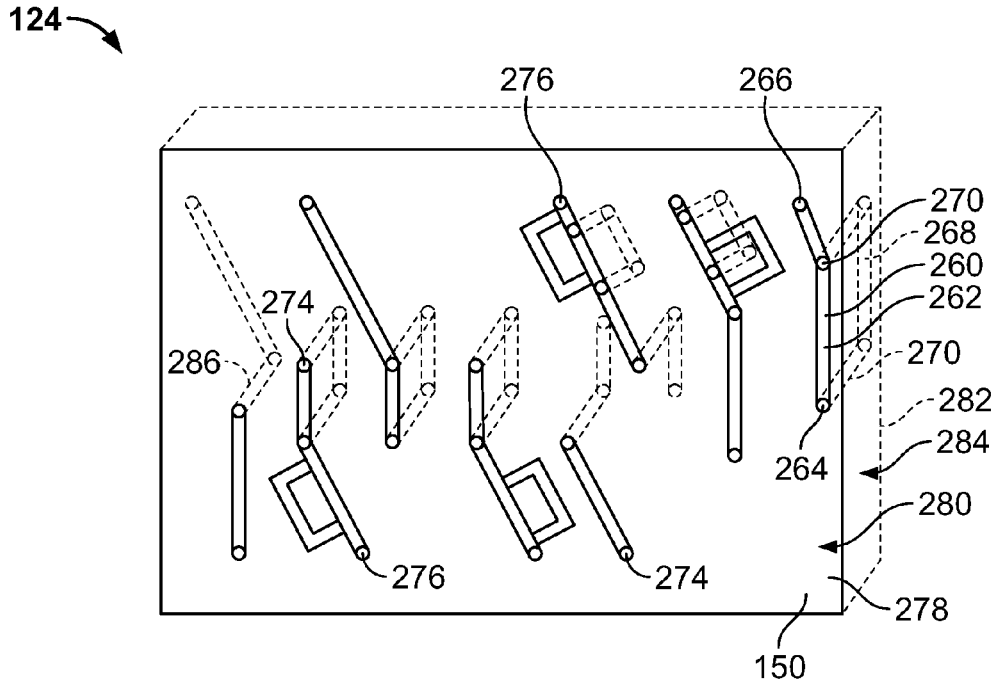
FIG. 5 is a schematic illustration of another alternative compensation component.

FIG. 5 is a schematic illustration of an alternative embodiment of the first compensation component 124. The compensation component 124 includes the substrate 150 and a plurality of traces 260. Each trace 260 includes a primary trace 262 that extends between a first end 264 and a second end 266. Additionally, at least a portion of the traces 260 include at least one compensation loop 268 that defines a secondary trace connected to the primary trace 262 at tap points 270. The primary trace 262 and the compensation loops 268 cooperate to define paths or circuits. In the illustrated embodiment, eight traces 260 are provided that correspond to, and provide compensation for, eight of the mating contacts 118.

A first interface 274 is provided at the first end 264 of each of the primary traces 262. A second interface 276 is provided at the second end 266 of each of the primary traces 262. The interfaces 274 provide a location for interfacing with the mating contacts 118 (shown in FIG. 2), and the interfaces 276 provide a location for interfacing with the wire terminating contacts 122. Both interfaces 274, 276 define through-holes for receiving the respective contacts 118, 122. Signals or power may be passed along the primary trace 262 and/or the compensation loops 268 between the interfaces 274, 276.

In an exemplary embodiment, the primary traces 262 are each provided on a top surface 278 of the substrate 150. The top surface 278 defines a first trace plane 280. At least some of the compensation loops 268 are also provided on the first trace plane 280. Optionally, at least some of the compensation loops 268 may be provided on a bottom surface 282 of the substrate 150, which defines a second trace plane 284. The traces 260 may extend along vias 286 that extend between the top surface 278 and the bottom surface 282. In alternative embodiments, additional trace planes may be provided on which the compensation loops 268 may be provided.

In the illustrated embodiment, the first interfaces 274 are arranged along two parallel rows. The second interfaces 276 are also arranged along two parallel rows with one of the rows being arranged on one side of the first interfaces 274 and the other row being arranged on the other side of the first interfaces 274. The primary traces 262 extend along paths on the first trace plane 280 between corresponding ones of the interfaces 274, 276. The primary traces 262 may extend along linear paths or along paths that have at least one turn. In the illustrated embodiment, the primary traces 262 extend along paths that are different from one another and have different lengths. The compensation loops 268 are located in predetermined locations and with predetermined lengths and/or widths to provide electrical and/or thermal compensation. The compensation loops 268 extend from the primary traces 262. The compensation loops 268 may extend perpendicularly from, or obliquely from the primary traces 262.

Figure 6:
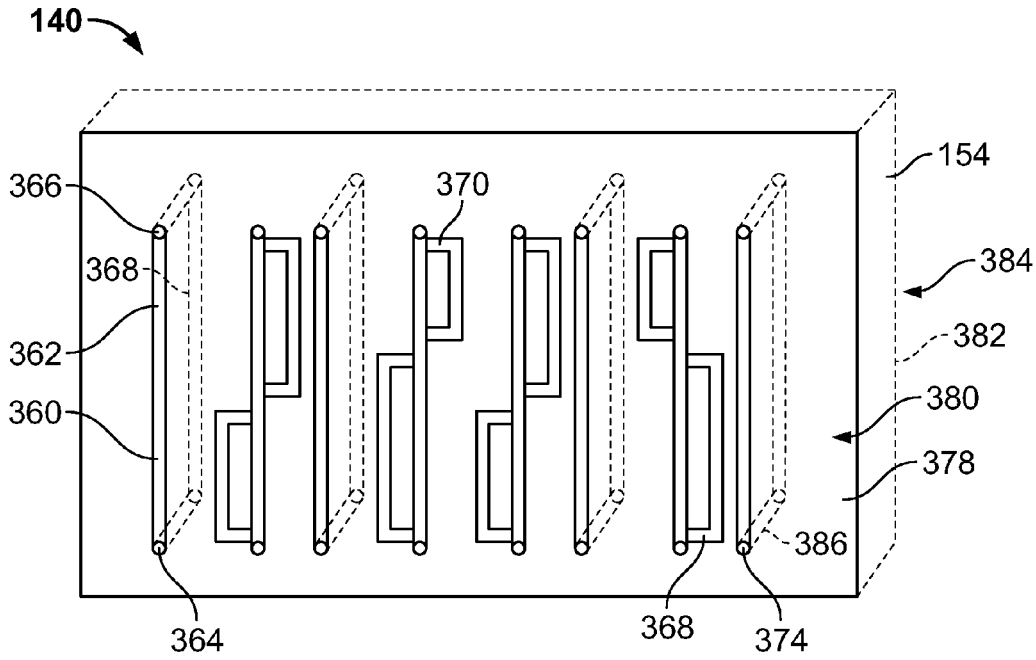
FIG. 6 is a schematic illustration of a further alternative compensation component.

FIG. 6 is a schematic illustration of the second compensation component 140 that is formed in accordance with an exemplary embodiment. The compensation component 140 includes the substrate 154 and a plurality of traces 360. Each trace 360 includes a primary trace 362 that extends between a first end 364 and a second end 366. Additionally, at least a portion of the traces 360 include at least one compensation loop 368 that defines a secondary trace connected to the primary trace 362 at tap points 370. The primary trace 362 and the compensation loops 368 cooperate to define paths or circuits. In the illustrated embodiment, eight traces 360 are provided that correspond to, and provide compensation for, eight of the mating contacts 118.

A first interface 374 is provided at the first end 364 of each of the primary traces 362. The interfaces 374 provide a location for interfacing with the mating contacts 118 (shown in FIG. 3). For example, the interfaces 374 define contact pads for mating with the mating contacts 118. Signals or power may be passed along the primary trace 362 and/or the compensation loops 368 between the first and second ends 364, 366.

In an exemplary embodiment, the primary traces 362 are each provided on a top surface 378 of the substrate 154. The top surface 378 defines a first trace plane 380. At least some of the compensation loops 368 are also provided on the first trace plane 380. Optionally, at least some of the compensation loops 368 may be provided on a bottom surface 382 of the substrate 154, which defines a second trace plane 384. The traces 360 may extend along vias 386 that extend between the top surface 378 and the bottom surface 382. In alternative embodiments, additional trace planes may be provided on which the compensation loops 368 may be provided.

In the illustrated embodiment, the first interfaces 374 are arranged along a single row. The second ends 366 are also arranged along a single row. The primary traces 162 extend along linear, parallel paths on the first trace plane 380 between the first and second ends 364, 366. The primary traces 362 thus each have the same length. Alternatively, the first and/or second ends 364, 366 of the primary traces 362 may not be arranged in rows such that the primary traces 362 have different lengths. The compensation loops 368 are located in predetermined locations and with predetermined lengths and/or widths to provide electrical and/or thermal compensation. The compensation loops 368 extend from the primary traces 362. The compensation loops 368 may extend perpendicularly from, or obliquely from the primary traces 362.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a housing;

a plurality of contacts within the housing; and a compensation component housed within the housing, the compensation component having a substrate with a first trace plane and a second trace plane, the compensation component having a plurality of traces arranged on the first trace plane, the traces being electrically connected to selected ones of the contacts, wherein at least one of the traces includes a compensation loop arranged at least in part on the first trace plane, and at least one of the traces includes a compensation loop arranged at least in part on the second trace plane, wherein the compensation loop provides at least one of electrical and thermal compensation.

2. The electrical connector of claim 1, wherein each compensation loop includes at least two tap points along the respective trace.

3. The electrical connector of claim 1, wherein at least one of the traces includes a compensation loop extending from the trace in a first direction and another compensation loop extending from the trace in a second direction different than the first direction.

4. The electrical connector of claim 1, wherein each trace includes a primary trace, each primary trace arranged within the first trace plane and extending parallel to one another, wherein each trace includes at least one compensation loop that extends substantially perpendicular from the primary trace.

5. The electrical connector of claim 1, wherein each trace includes a primary trace and the compensation loops, each compensation loop being positioned relatively closer to an adjacent trace to increase an amount of inductive coupling therebetween.

6. The electrical connector of claim 1, wherein the contacts are configured for power transmission, each compensation loop splits the current path defined by the trace into parallel paths to reduce the heat generated for a given region of the current path.

7. The electrical connector of claim 1, wherein the length and proximity of the compensation loops are selected to control the electrical performance of the electrical connector.

8. The electrical connector of claim 1, wherein the substrate defines multiple layers with each layer defining a potential trace plane, wherein compensation loops are provided on at least three of the potential trace planes.

9. The electrical connector of claim 1, wherein the contacts are either directly or indirectly coupled to the traces.

10. An electrical connector comprising:

a housing;

a plurality of contacts within the housing;

a compensation component housed within the housing, the compensation component having a substrate and a plurality of traces electrically connected to selected ones of the contacts, wherein each of the traces include at least one compensation loop having at least two tap points along the respective trace, the compensation loops being arranged to control the electrical performance of the electrical connector.

11. The electrical connector of claim 10, wherein the electrical performance is controlled by controlling the amount of inductive or capacitive coupling between certain ones of the traces.

12. The electrical connector of claim 10, wherein at least one of the traces includes a compensation loop extending in a first direction and another compensation loop extending in a second direction different than the first direction.

13. The electrical connector of claim 10, wherein the length and proximity of the compensation loops are selected to control the electrical performance of the electrical connector.

14. The electrical connector of claim 10, wherein the substrate defines multiple layers, wherein compensation loops are provided on at least three of the layers.

15. The electrical connector of claim 10, wherein the compensation loops have a length selected to control an amount of heat dissipation by splitting the current from the trace to the compensation loop.

16. An electrical connector comprising:

a housing;

a plurality of contacts within the housing;

a compensation component housed within the housing, the compensation component having a substrate with a top and a bottom, the compensation component also having four traces arranged on the top of the substrate, with first and second traces defining a first differential pair and third and fourth traces defining a second differential pair, each trace having at least one compensation loop extending therefrom, the compensation loops being arranged to control the electrical performance of the electrical connector.

17. The electrical connector of claim 16, wherein the compensation loops associated with the first and third traces are arranged along the bottom of the substrate.

18. The electrical connector of claim 16, wherein the substrate includes an intermediate layer between the top and the bottom, at least two of the traces include compensation loops arranged along the intermediate layer to provide either inductive or capacitive coupling therebetween.

19. The electrical connector of claim 16, wherein the substrate includes an intermediate layer between the top and the bottom, the third trace having a compensation loop arranged along the intermediate layer to control coupling between the first and third traces, and the fourth trace having a compensation loop arranged along the intermediate layer to control coupling between the second and fourth traces.

20. The electrical connector of claim 16, wherein at least one of the second and third traces includes a compensation loop arranged along the top of the substrate that extends between the second and third traces to control coupling between the second and third traces.

* * * * *